US011624238B1

(12) United States Patent
Xiao et al.

(10) Patent No.: US 11,624,238 B1
(45) Date of Patent: Apr. 11, 2023

(54) DEEPWATER SUBSEA COILED TUBING DRILLING RIG

(71) Applicant: China University of Petroleum (East China), Shandong (CN)

(72) Inventors: Wensheng Xiao, Shandong (CN); Lianpeng Mei, Shandong (CN); Junguo Cui, Shandong (CN); Qingxue Zhang, Shandong (CN); Hongyan Wang, Shandong (CN); Lei Wu, Shandong (CN); Changjiang Li, Shandong (CN); Liping Tan, Shandong (CN); Chao Liu, Shandong (CN)

(73) Assignee: CHINA UNIVERSITY OF PETROLEUM (EAST CHINA), Shandong (CN)

( * ) Notice: Subject to any disclaimer, the term of this patent is extended or adjusted under 35 U.S.C. 154(b) by 0 days.

(21) Appl. No.: 17/819,645

(22) Filed: Aug. 15, 2022

(30) Foreign Application Priority Data

Jun. 10, 2022 (CN) ..... 202210655157.2

(51) Int. Cl.
*E21B 7/124* (2006.01)
*E21B 7/128* (2006.01)
*E21B 19/22* (2006.01)

(52) U.S. Cl.
CPC ..... *E21B 7/128* (2013.01); *E21B 19/22* (2013.01)

(58) Field of Classification Search
CPC ..... E21B 7/124; E21B 7/128; E21B 19/22
See application file for complete search history.

(56) References Cited

U.S. PATENT DOCUMENTS 6,488,093 B2 * 12/2002 Moss ..... E21B 19/22 166/365
7,036,598 B2 * 5/2006 Skj ..... E21B 19/22 166/365
7,165,619 B2 * 1/2007 Fox ..... E21B 19/146 166/77.2
7,584,796 B2 * 9/2009 Ayling ..... E21B 7/124 166/380
9,140,068 B2 * 9/2015 Bauer ..... E21B 21/12
11,512,535 B2 * 11/2022 Elliot ..... E21B 19/002
2022/0003062 A1 * 1/2022 Wiener ..... E21B 49/025

FOREIGN PATENT DOCUMENTS

CN 102606074 B 4/2014
CN 108868612 A 11/2018
WO WO-2007129899 A1 * 11/2007 ..... E21B 19/143

* cited by examiner

*Primary Examiner* — Matthew R Buck
(74) *Attorney, Agent, or Firm* — Mark T. Vogelbacker; Eckert Seamans Cherin & Mellott, LLC

(57) ABSTRACT

A deepwater subsea coiled tubing drilling rig includes a lifting rack having an upper rack and a lower rack which are sleeved with each other and connected by a lifting device. A working space is enclosed by the upper rack and the lower rack, and an underwater connecting and disconnecting tool is installed in the working space; the working space is transformed between a high-position large-space state for connecting and disconnecting through the tool and a low-position small-space state for the drilling process, along with the up-down movement of the upper rack. The upper rack is provided with an underwater coiled tubing system used for lowering and lifting a downhole tool combination, and the lower rack is provided with a wellhead device.

18 Claims, 5 Drawing Sheets

DEEPWATER SUBSEA COILED TUBING DRILLING RIG

CROSS REFERENCE TO RELATED APPLICATION

This patent application claims the benefit and priority of Chinese Patent Application No. 202210655157.2 filed on Jun. 10, 2022, the disclosure of which is incorporated by reference herein in its entirety as part of the present application.

TECHNICAL FIELD

The present disclosure relates to the technical field of offshore rigs, and in particular relates to a deepwater subsea coiled tubing drilling rig.

BACKGROUND ART

Natural gas hydrate is a strategic alternative energy source to oil and natural gas. At present, the offshore natural gas hydrate producing test employs a large floating drilling platform (vessel) for implementation. The drilling capacity of large floating drilling rigs (vessels) is much larger than the demand for offshore natural gas hydrate exploitation, and huge in the construction or leasing costs, which significantly pushes up the cost of offshore natural gas hydrate exploitation and is unable to achieve economic exploitation. Furthermore, the large floating drilling platform (vessel) also has the problems of low drilling efficiency, high technical difficulty and poor security, leading to restriction to the industrial development progress of the offshore natural gas hydrates.

A subsea drilling rig adopting a deep-water subsea drilling working mode is a feasible mode for replacing the large drilling platform (vessel) to economically develop the offshore natural gas hydrates. However, there are no subsea drilling rigs in the prior art for the drilling of the offshore natural gas hydrates. For example, a novel subsea deep hole pressure-holding coring drilling rig is disclosed in Chinese patent with a publication number CN 102606074 B. According to the solution, in order to meet the drilling and coring requirements of the drilling rig, a wider manipulator operation space is provided inside a cylindrical outer frame to carry out assembly and other operations. However, due to the fact that the demands of the working states of assembling and drilling (or coring) on the inner space are different, the problem of non-compact structure exists in the drilling (or coring), which may lead to unstable structure.

A subsea deep hole drilling rig is disclosed in Chinese patent with an application number CN 108868612 A. The subsea deep hole drilling rig includes a rack and a pipe storage rack. According to the solution, the rack and the pipe storage rack are separately provided to meet different demands of the drilling process (or sampling process) and the bit/tool replacing process on the rack body. However, the solution may increase the overall structure size of the rack body and increase cost, and is not conducive to the operation and implementation.

SUMMARY

An objective of the present disclosure is to provide a deepwater subsea coiled tubing drilling rig to solve the problems in the prior art. A working space is formed inside a lifting rack, and a change in size of the working space is achieved by utilizing ascending and descending of an upper rack, such that during the connecting and disconnecting through a tool, the working space is in a high-position large-space state to guarantee an enough connecting and disconnecting space; and in the drilling process, the working space is in a low-position small-space state to guarantee the stability of the whole machine structure.

To achieve the objective, the present disclosure provides the following technical solutions.

A deepwater subsea coiled tubing drilling rig provided by the present disclosure includes a lifting rack. The lifting rack includes an upper rack and a lower rack which are sleeved with each other and connected by a lifting device. A working space is enclosed by the upper rack and the lower rack, and an underwater connecting and disconnecting tool is installed in the working space; the working space is transformed between a high-position large-space state for connecting and disconnecting through the tool and a low-position small-space state for a drilling process along with up-down movement of the upper rack. The upper rack is provided with an underwater coiled tubing system used for lowering and lifting downhole tool combination, and the lower rack is provided with a wellhead device. In the connecting and disconnecting through the tool, the lifting device drives the upper rack to move upwards to the high-position large-space state, and then the downhole tool combination is separated from the wellhead device; and in the drilling process, the lifting device drives the upper rack to move downwards to the low-position small-space state, and then the downhole tool combination enters the wellhead device.

In some embodiments, the lifting device includes a hoist hydraulic cylinder and a guide rail pair, two ends of the hoist hydraulic cylinder are connected to a top of the upper rack and a bottom of the lower rack respectively, and the guide rail pair includes a vertical guide rail installed on the lower rack and a sliding block installed on the upper rack.

In some embodiments, the wellhead device includes a base located in a middle of the bottom of the lower rack, an upper part of the base is provided with a cement head and a blowout preventer from bottom to top in sequence, and a lower part of the base is provided with a foundation conductor.

In some embodiments, the underwater coiled tubing system includes a reel installed on the upper rack and a coiled tubing with cables which is wound on the reel; a free end of the coiled tubing with cables is used for connecting the downhole tool combination; and the underwater coiled tubing system further includes a hoisting device installed on the upper rack and an underwater heavy-load injector head installed on the hoisting device.

In some embodiments, the downhole tool combination includes a drilling tool string and a permanent magnet electric drill which are connected in sequence; the drilling tool string is connected to the coiled tubing with cables, the permanent magnet electric drill includes a drilling permanent magnet motor and a drill bit, and an electric measuring tool is arranged between the drilling permanent magnet motor and the drill bit.

In some embodiments, the underwater connecting and disconnecting tool includes an underwater manipulator installed inside the lower rack and at a middle of the lower rack, and an underwater iron roughneck installed at the bottom of the lower rack. The underwater connecting and disconnecting tool further includes an underwater slip, the underwater slip includes an upper slip and a lower slip, the upper slip is installed at a lower end of the underwater heavy-load injector head, the lower slip is installed at an upper end of the blowout preventer.

In some embodiments, two sides of the underwater manipulator are provided with tool holders, and the tool holders are fixedly connected into the lower rack.

In some embodiments, the deepwater subsea coiled tubing drilling rig includes an anti-sinking base for bearing the lifting rack, the bottom of the lower rack is provided with screw piles, and the anti-sinking base is provided with through holes corresponding to the screw piles and the wellhead device.

In some embodiments, the deepwater subsea coiled tubing drilling rig includes an underwater hydraulic power unit which is arranged at the bottom of the lower rack.

In some embodiments, the deepwater subsea coiled tubing drilling rig includes a subsea device and a water surface device. The subsea device includes the lifting rack and equipment borne and installed by the lifting rack, and the water surface device includes a control center installed on an auxiliary vessel; the subsea device and the water surface device are connected by a pipe cable system, and the pipe cable system includes an umbilical cable, a suspension cable, a drilling fluid hose and a cement hose.

Compared with the prior art, the present disclosure has the following technical effects.

(1) The working space is formed inside the lifting rack, by means of the ascending and descending of the upper rack, in the connecting and disconnecting through the tool, the working space is in the high-position large-space state to guarantee an enough space for connecting and disconnecting; and in the drilling process, the working space is in the low-position small-space state to guarantee the stability of the whole machine structure.

(2) By providing the working space in the lifting rack, the underwater connecting and disconnecting tool is installed in the working space and is cooperatively provided with the underwater manipulator and the tool holder, such that the deepwater subsea coiled tubing drilling rig has a plurality of functions such as deepwater drilling, geological coring, downhole in-situ stratum data real-time collection, and can be entirely hoisted to achieve the coiled tubing drilling process of the deepwater subsea "one-trip drilling" type, thereby significantly reducing the cost of deepwater drilling, matching the drilling capacity with the exploitation demands for the offshore natural gas hydrate, and enabling the deepwater subsea coiled tubing drilling rig to be suitable for economic development engineering drilling for the offshore natural gas hydrate.

The subsea device and the water surface device are connected by the pipe cable system, and the lifting rack of the subsea device and accessory equipment thereof are connected to the auxiliary vessel and the control center of the water surface device, such that the remote control from the auxiliary vessel can be achieved to perform deepwater underwater unmanned operation, thereby reducing the work intensity of the worker, and effectively improving the safety of the drilling rig.

By employing the permanent magnet electric drill as the downhole power drilling tool, the power and signal can be transmitted to the drilling tool by the coiled tubing with cables, which is convenient for real-time communication between the control center and downhole information, and can improve drilling efficiency and wellbore trajectory accuracy.

BRIEF DESCRIPTION OF THE DRAWINGS

To illustrate the technical solution of the present disclosure more clearly, the following briefly describes the accompanying drawings.

Figure 1:
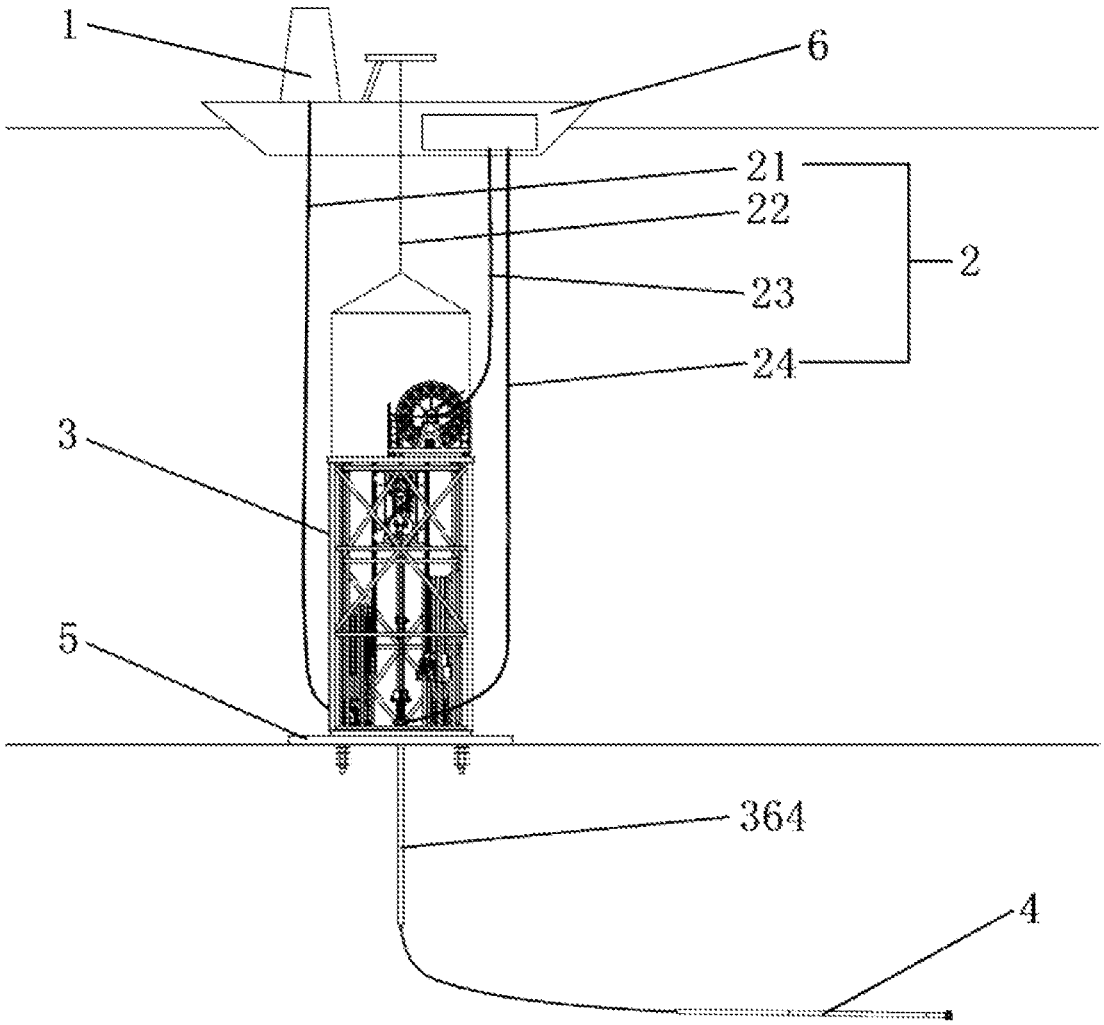
FIG. 1 is a schematic diagram of an overall structure according to the present disclosure.

Reference numerals: 1—control center; 2—pipe cable system; 21—umbilical cable; 22—suspension cable; 23—drilling fluid hose; 24—cement hose; 3—subsea device; 31—lifting rack; 311—upper rack; 312—lower rack; 313—hoist hydraulic cylinder; 32—underwater coiled tubing system; 321—reel; 322—coiled tubing with cables; 323—reel guide rail; 324—hoisting device; 325—underwater heavy-load injector head; 33—underwater connecting and disconnecting tool; 331—underwater manipulator; 332—underwater iron roughneck; 333—underwater slip; 3331—upper slip; 3332—lower slip; 34—tool holder; 35—underwater hydraulic power unit; 36—wellhead device; 361—base; 362—cement head; 363—blowout preventer; 364—foundation conductor; 37—screw pile; 4—downhole tool combination; 41—drilling tool string; 42—permanent magnet electric drill; 421—drilling permanent magnet motor; 422—drill bit; 43—electric measuring tool; 5—anti-sinking base; 6—auxiliary vessel.

DETAILED DESCRIPTION OF THE EMBODIMENTS

An objective of the present disclosure is to provide a deepwater subsea coiled tubing drilling rig to solve the problems in the prior art. A working space is defined inside a lifting rack, and the change in size of the working space is achieved by utilizing the ascending and descending of an upper rack, such that in the connecting and disconnecting of a tool, the lifting rack is in a high-position large-space state to guarantee an enough connecting and disconnecting space; and in the drilling process, the lifting rack is in a low-position small-space state to guarantee the stability of the whole machine structure.

The following further describes the present disclosure in detail with reference to the accompanying drawings.

As shown in FIG. 1 to FIG. 6, a deepwater subsea coiled tubing drilling rig provided by the present disclosure includes a subsea device 3 sinking into the seabed, the subsea device 3 includes a lifting rack 31, the lifting rack 31 includes an upper rack 311 and a lower rack 312 which are sleeved with each other and connected by a lifting device. The upper rack and the lower rack may be of frame structure, and different internal spaces are formed by the lower rack and the upper rack. The internal spaces are communicated to define a working space; and under driving of the lifting device, the working space can be changed in a size thereof. An underwater connecting and disconnecting tool 33 is installed inside the working space. The working space respectively forms a high-position large-space state and a low-position small-space state along with the up-down movement of the upper rack 311. The upper rack 311 is provided with an underwater coiled tubing system 32 for lowering and lifting the downhole tool combination 4, and the lower rack 312 is provided with a wellhead device 36. In the connecting and disconnecting of the tool, the lifting device drives the upper rack 311 to move upwards to the high-position large-space state, and then the downhole tool combination 4 can be separated from the wellhead device 36. At the moment, an operation space for the underwater connecting and disconnecting tool 33 is provided, facilitating to connect and disconnect the downhole tool combination 4. In the drilling process, the lifting device drives the upper rack 311 to move downwards to the low-position small-space state, and then the downhole tool combination 4 enters the wellhead device 36. At the moment, due to the retraction of the lifting rack 31, a more stable overall structure can be obtained, and the safety of the subsea work can be improved.

Figure 2:
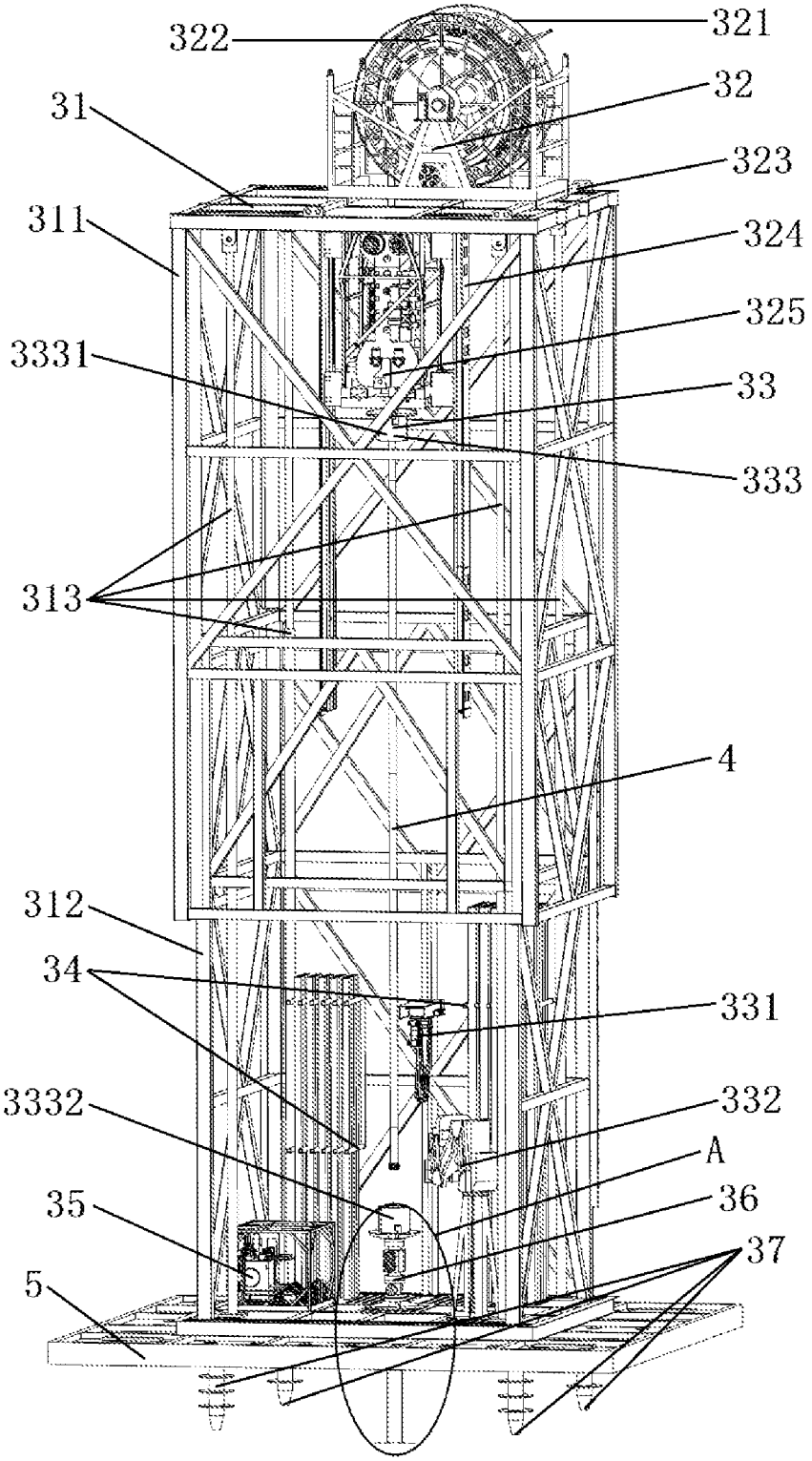
FIG. 2 is a schematic structural diagram of a lifting rack in a high-position large-space state according to the present disclosure.
Figure 3:
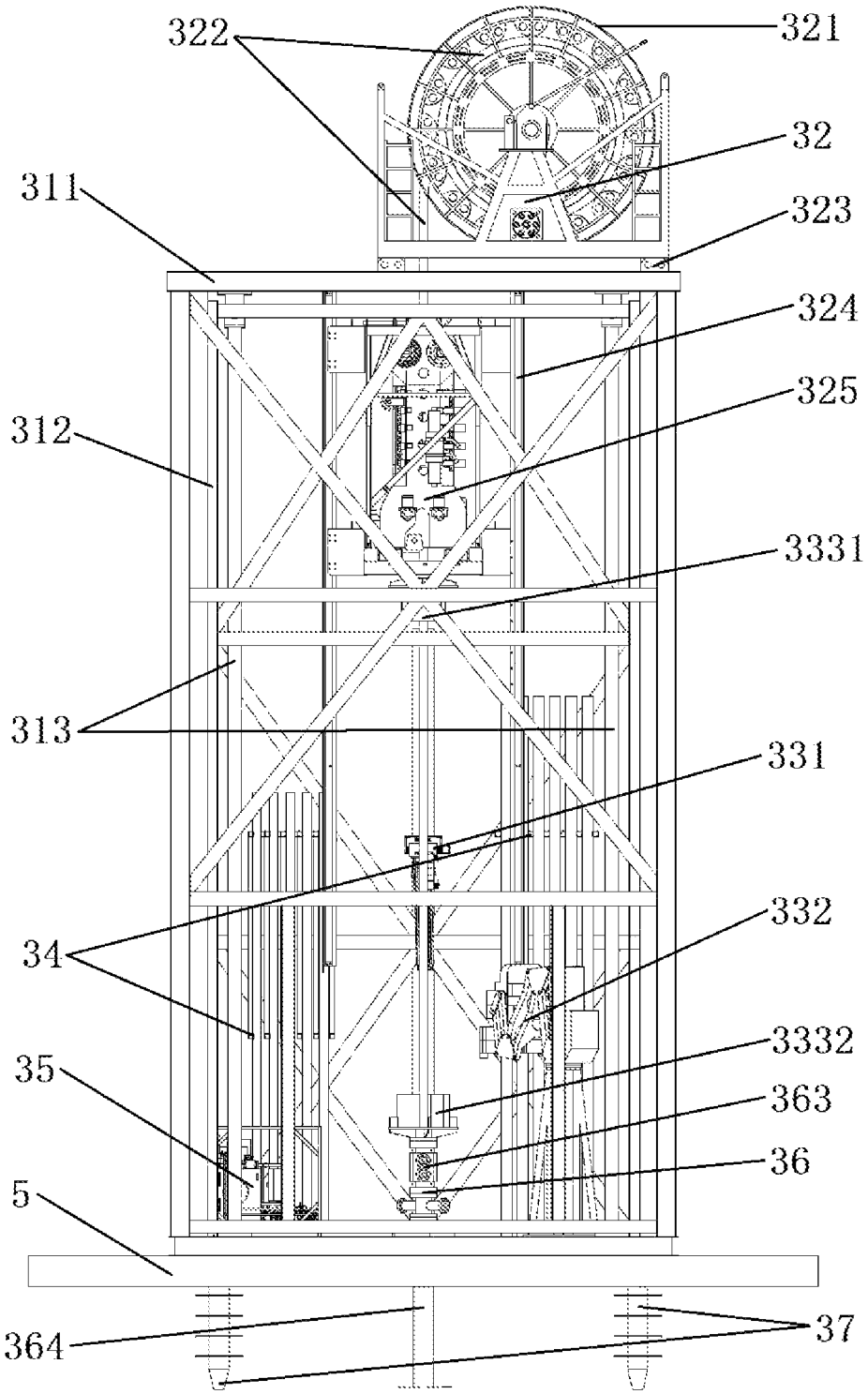
FIG. 3 is a front schematic structural diagram of the lifting rack in a low-position small-space state according to the present disclosure.
Figure 4:
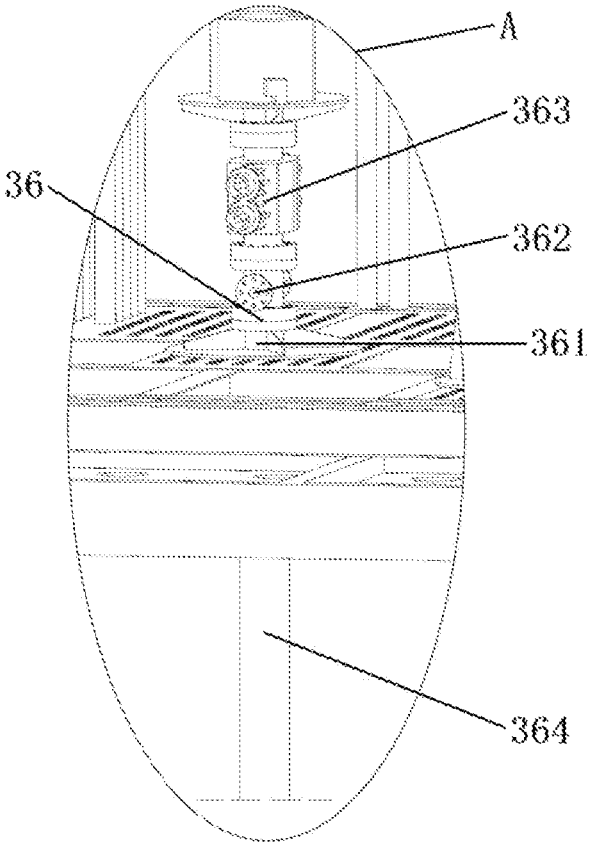
FIG. 4 is an enlarged schematic structural diagram of an A portion in FIG. 2.

As shown in FIG. 2 to FIG. 3, the lifting device may include a hoist hydraulic cylinder 313 and a guide rail pair. The hoist hydraulic cylinder 313 may be provided at a corner of the lifting rack 31, when the lifting rack 31 is of a rectangular frame structure, four hoist hydraulic cylinders 313 are provided, and two ends of each hoist hydraulic cylinder 313 are respectively connected to a top of the upper rack 311 and a bottom of the lower rack 312. Under driving action of the hoist hydraulic cylinder 313, the upper rack 311 is ascended and descended. The guide rail pair may include a vertical guide rail installed on the lower rack 312 and a sliding block installed on the upper rack 311. The sliding block moves on the vertical guide rail to guide and limit the ascending and descending of the upper rack 311.

As shown in FIG. 2 to FIG. 3, the wellhead device 36 includes a base 361 installed in a middle of the bottom of the lower rack 312. The base 361 is used for installing well-control equipment and wellhead equipment. For example, the upper part of the base 361 is provided with a cement head 362 and a blowout preventer 363 from bottom to top in sequence, and the lower part of the base 361 is provided with a foundation conductor 364.

As shown in FIG. 2 to FIG. 3, the underwater coiled tubing system 32 includes a reel 321 installed on the upper rack 311 and a coiled tubing with cables 322 which is wound on the reel 321, and the pay-off and take-up of the coiled tubing with cables 322 is achieved through rotation of the reel 321. A free end of the coiled tubing with cables 322 is used for connecting the downhole tool combination 4 and used for transmitting dynamic electricity and control signals to a permanent magnet electric drill 42, an electric measuring tool 43 and the like, and conveying drilling fluid downhole. The sinking and lifting of the downhole tool combination 4 can be achieved during the pay-off and take-up of the coiled tubing with cables 322. The reel 321 is slidably connected to the reel guide rail 323, the reel guide rail 323 is fixed onto the top of the upper rack 311 and is parallel to an axial direction of the reel 321. During recovery and injection of the coiled tubing with cables 322, the orderly winding of the coiled tubing with cables 322 on the reel 321 can be achieved by controlling the dynamic displacement of the reel 321 on the reel guide rail 323. During the design of the coiled tubing with cables 322, the cable can be embedded into a tubing wall of the tubing body, which solves the problem of bumping, corrosion and the like caused by external arrangement of the cable in the operating process, and avoids the problem that the cable sheath is easy to damage due to the fact that the cable directly penetrates through the tube of the coiled tubing with cables 322. The underwater coiled tubing system 32 further includes a hoisting device 324 installed below the top of the upper rack 311 and an underwater heavy-load injector head 325 installed on the hoisting device 324. Under the action of the hoisting device 324, the hoisting and descending of the underwater heavy-load injector head 325 can be achieved. The reel 321, the reel guide rail 323, the hoisting device 324, the underwater heavy-load injector head 325 and the like are all subjected to pressure-resistant sealing and pressure compensation design, and can be suitable for deep-water underwater operation.

Figure 6:
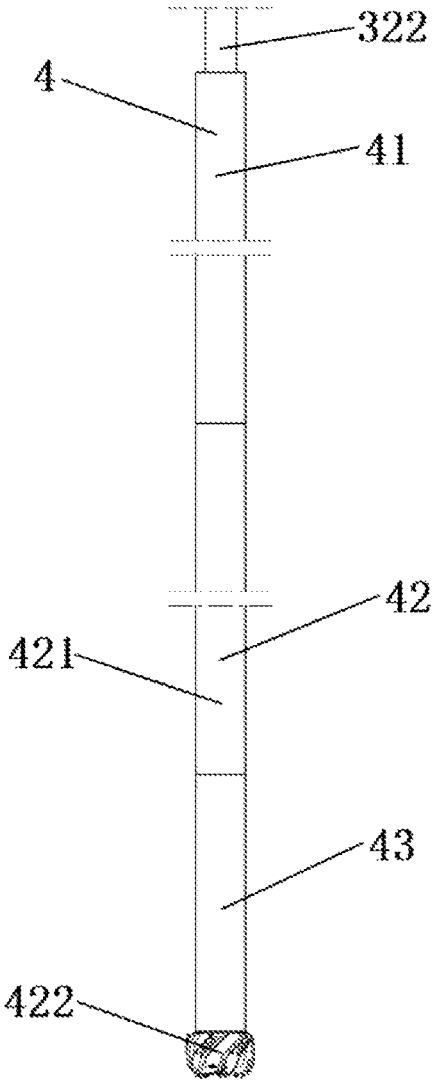
FIG. 6 is a schematic structural diagram showing a downhole tool combination according to the present disclosure.

As shown in FIG. 6, the downhole tool combination 4 includes a drilling tool string 41 and a permanent magnet electric drill 42 connected in sequence. The drilling tool string 41 mainly includes a connector, a non-rotating joint, a lifting sub, a release sub, a crossover coupling, a check valve and other tools, the upper end of the drilling tool string 41 is connected to the coiled tubing with cables 322, and the lower end of the drilling tool string 41 is connected to the permanent magnet electric drill 42. The permanent magnet electric drill 42 provides power for the drilling and coring operations, and includes a permanent magnet motor 421 and a drill bit 422. An electric measuring tool 43 is provided between the permanent magnet motor and the drill bit to achieve real-time measurement of in-site stratum data in the drilling process.

As shown in FIG. 2 to FIG. 3, the underwater connecting and disconnecting tool 33 includes an underwater manipulator 331 installed in the middle of the lower rack 312 and within the lower rack 312, and an underwater iron roughneck 332 installed at the bottom of the lower rack 312. The underwater manipulator 331 is used for grabbing a casing and a downhole tool. The underwater iron roughneck 332 is used for makeup and breakout during casing running and tool connecting and disconnecting. The underwater connecting and disconnecting tool 33 further includes an underwater slip 333 for fixing during casing running and tool connecting and disconnecting. The underwater slip 333 includes an upper slip 3331 and a lower slip 3332. The upper slip 3331 is installed at the lower end of the underwater heavy-load injector head 325, and the lower slip 3332 is installed at the upper end of the blowout preventer 363 of the wellhead device 36.

As shown in FIG. 2 to FIG. 3, the tool holders 34 for placing the casing and the downhole tools are arranged in the lower rack 312 and at both sides of the underwater manipulator 331, thus facilitating the underwater manipulator 331 to grab and place the casing and the downhole tools.

Figure 5:
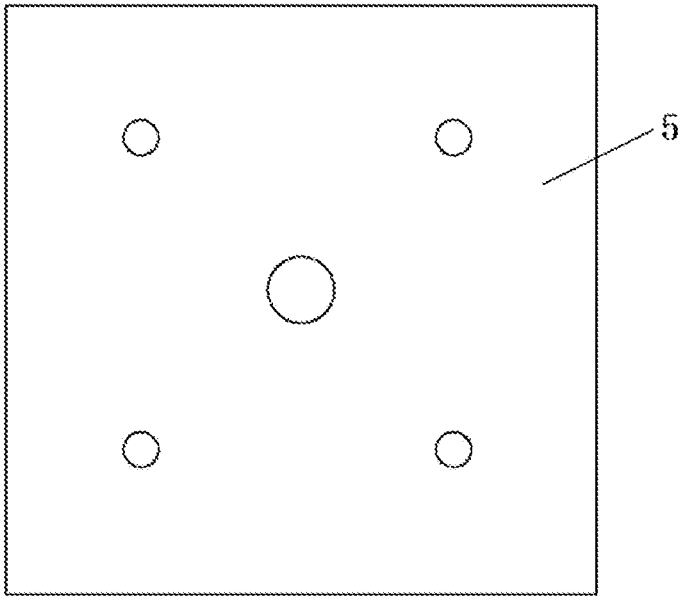
FIG. 5 is a schematic diagram showing position arrangement of a through hole of an anti-sinking base according to the present disclosure.

As shown in FIG. 2, FIG. 3 and FIG. 5, the deepwater subsea coiled tubing drilling rig includes an anti-sinking base 5 for bearing the lifting rack 31, all corners of the bottom of the lower rack 312 are provided with screw piles 37, for example, with four screw piles. The anti-sinking base 5 is used for bearing the load of the underwater equipment and transferring the load to the seabed, and serves as an installation foundation of the subsea device 3 to be set into the seabed in advance. The anti-sinking base 5 is provided with through holes corresponding to the screw piles 37 and the wellhead device 36. When the subsea device 3 sit on the bottom, the wellhead device 36 and the screw piles 37 can pass through the corresponding holes, the screw piles 37 are used for being screwed into the seabed after the subsea device sits on the bottom so as to fix and level the lifting rack 31.

As shown in FIG. 2 to FIG. 3, the deepwater subsea coiled tubing drilling rig includes an underwater hydraulic power unit 35. The underwater hydraulic power unit 35 is arranged at the bottom of the lower rack 312 and used for providing source power for each hydraulic power device of the subsea device 3.

As shown in FIG. 1, the water surface device includes a control center 1 arranged on an auxiliary vessel 6 and the like. The subsea device 3 and the water surface device (the control center 1 and other equipment on the auxiliary vessel 6) are connected by a pipe cable system 2, and the pipe cable system 2 includes an umbilical cable 21, a suspension cable 22, a drilling fluid hose 23, and a cement hose 24. One end of the umbilical cable 21 is connected to the control center 1, and the other end of the umbilical cable is connected to the subsea device 3, thus providing the dynamic electricity and control signal to the subsea device 3 from the auxiliary vessel 6. One end of the suspension cable 22 is connected to a hoisting device on the auxiliary vessel 6, the other end of the suspension cable is connected to the lifting rack 31, and the auxiliary vessel 6 lowers and recovers the subsea device 3 via the suspension cable 22. One end of the drilling fluid hose 23 is connected to a mud system on the auxiliary vessel 6, the other end of the drilling fluid hose is connected to the coiled tubing with cables 322, and the drilling fluid flows through the drilling fluid hose 23, the coiled tubing with cables 322 and the downhole tool combination 4 in sequence to reach the downhole. One end of the cement hose 24 is connected to a cement system on the auxiliary vessel 6, the other end of the cement hose is connected to the cement head 362, and the cement system conveys cement for well cementation between the casing and a shaft through the cement hose 24.

The specific operating process of the present disclosure is described as follows:

The auxiliary vessel 6 is loaded with the control center 1, the pipe cable system 2, the subsea device 3, the downhole tool combination 4 and the anti-sinking base 5 and is transported to a designated sea area.

The control center 1 is installed on the auxiliary vessel 6, the underwater coiled tubing system 32, the underwater connecting and disconnecting tool 33, the tool holder 34, the underwater hydraulic power unit 35, the wellhead device 36, the screw piles 37 and the other equipment are installed on the lifting rack 31 to complete the pipeline connection among the umbilical cable 21, the drilling fluid hose 23, the cement hose 24 and the equipment, thus completing connection of various components of the downhole tool combination 4. The coiled tubing with cables 322 is led into the underwater heavy-load injector head 325 and then passes out from the lower end of the underwater heavy-load injector head 325 so as to be connected to the underwater tool combination 4 at the end part of the underwater heavy-load injector head 325. After completing the connection and assembling of the equipment, an equipment operation test is carried out on the auxiliary vessel 6.

The anti-sinking base 5 is lowered to a preset well location region of the seabed by the hoisting device.

Before the subsea device enters the water, the lifting rack 31 is in the low-position small-space state, the underwater tool combination 4 extends into the foundation conductor 364. The hoisting device lowers the subsea device 3 by the suspension cable 22, and the umbilical cable 21, the drilling fluid hose 23 and the cement hose are lowered accordingly. When the foundation conductor 364 is lowered to being close to a seabed mudline, the jet drilling is carried out for installing the conductor. The foundation conductor 364 drills into the strata by means of the own weight of the subsea device 3, and furthermore, the mud system on the auxiliary vessel 6 conveys the drilling fluid to provide hydraulic flushing. The drilling permanent magnet motor 421 drives the drill bit 422 to rotate, and the drilling fluid carries rock debris from an annular space between the foundation conductor 364 and the underwater tool combination 4 to the wellhead and discharges the rock debris into the sea. While carrying out the conductor installation by jet drilling, the subsea device 3 is slowly lowered until the lifting rack 31 sits on the anti-sinking base 5 which is lowered in advance. After the lifting rack 31 is in the bottom, the screw piles 37 are turned on to level and fix the lifting rack 31.

The underwater coiled tubing system 32 and the permanent magnet electric drill 42 are controlled to carry out continuous drilling operation when the lifting rack 31 is in the low-position small-space state. The mud system on the auxiliary vessel 6 conveys seawater downhole as drilling fluid through the drilling fluid hose 23 and the coiled tubing with cables 322, where the drilling fluid carries the rock debris to the wellhead and then discharges it to the seabed. In the drilling process, the electric measuring tool 43 is used for performing in-situ stratum data real-time measurement.

After drilling to a designated depth, the underwater coiled tubing system 32 lifts the downhole tool combination 4 to above the wellhead device 36; and furthermore, the lifting rack 31 is hoisted to the high-position large-space state. The upper slip 3331 is controlled to clamp the upper end of the downhole tool combination 4, and the underwater iron roughneck 332 is controlled to carry out breakout between the electric measuring tool 43 and the drilling permanent magnet motor 421. After completing the breakout, the underwater manipulator 332 grabs the electric measuring tool 43 connected with a drill bit 422 and places the electric measuring tool on the tool holder 34. Afterwards, the underwater manipulator 331 grabs a coring tool placed on the tool holder 34 in advance and then conveys the coring tool to below the drilling permanent magnet motor 421, and the underwater iron roughneck 332 is used for makeup connection. After completing the installation of the coring tool, the upper slip 3331 is loosened, the lifting rack 31 descends to the low-position small-space state, and the underwater coiled tubing system 32 conveys the coring tool downhole for geological coring operation. After completing the coring operation, the coring tool is replaced with the electric measuring tool 43 with the drill bit 422 according to the above steps for continuous drilling operation.

After completing the drilling operation, the underwater coiled tubing system 32 lifts a connection joint where the coiled tubing with cables 322 and the downhole tool combination 4 are connected, to above the wellhead device 36; and meanwhile, the lifting rack 31 is hoisted to the high-position large-space state. The lower slip 3332 is controlled to clamp the downhole tool combination 4, and the underwater iron roughneck 332 is controlled for performing breakout between the coiled tubing with cables 322 and the downhole tool combination 4. The underwater manipulator 331 grabs the downhole tool combination 4, the lower slip 3332 is loosened, and the underwater manipulator 331 places the downhole tool combination 4 on the tool holder 34. Afterwards, the underwater manipulator 331 grabs a casing placed on the tool holder 34 in advance and then conveys the casing to below the underwater heavy-load injector head 325, and the upper slip 3331 is controlled to clamp the upper end of the casing. The hoisting device 324 is controlled to descend the underwater heavy-load injector head 325 to convey the casing into the wellhead device 36. The lower slip 3332 clamps the casing, the upper slip 3331 is loosened, and the hoisting device 324 hoists the underwater heavy-load injector head 325 to the top end. The underwater manipulator 331 grabs the next section of casing and conveys the next section of casing to a position above the previous section of casing, and the underwater iron roughneck 332 is controlled to carry out makeup connection on the next section of casing and the previous section of casing. After completing the connection, the upper slip 3331 is controlled to clamp the upper end of the second section of casing, the lower slip 3332 is loosened, the hoisting device 324 descends the underwater heavy-load injector head 325 to convey the second section of casing into the wellhead device 36. The above steps are repeated for carrying out casing running connection operation.

After completing the operation of casing running, the lifting rack 31 descends to the low-position small-space state, and the cement system on the auxiliary vessel 6 pumps cement between the casing and the wellbore wall through the cement hose 24 for well cementation.

After completing the well cementation, the screw piles 37 are screwed out, and the hoisting device recovers the subsea device 3 to the auxiliary vessel 6 through the suspension cable 22.

The above description of the principles and implementation of the present disclosure is only used to help understand the method of the present disclosure and its core ideas, and the contents of this specification should not be construed as a limitation of the present disclosure.

What is claimed is:

1. A deepwater subsea coiled tubing drilling rig, comprising a lifting rack, wherein the lifting rack comprises an upper rack and a lower rack which are sleeved with each other and connected by a lifting device, a working space is enclosed by the upper rack and the lower rack, and an underwater connecting and disconnecting tool is installed in the working space; the working space is transformed between a high-position large-space state for connecting and disconnecting through the tool and a low-position small-space state for a drilling process, along with up-down movement of the upper rack; the upper rack is provided with an underwater coiled tubing system used for lowering and lifting downhole tool combination, and the lower rack is provided with a wellhead device; during the connecting and disconnecting through the tool, the lifting device drives the upper rack to move upwards to the high-position large-space state, and then the downhole tool combination is separated from the wellhead device; and in the drilling process, the lifting device drives the upper rack to move downwards to the low-position small-space state, and then the downhole tool combination enters the wellhead device.

2. The deepwater subsea coiled tubing drilling rig according to claim 1, wherein the lifting device comprises a hoist hydraulic cylinder and a guide rail pair, two ends of the hoist hydraulic cylinder are connected to a top of the upper rack and a bottom of the lower rack respectively, and the guide rail pair comprises a vertical guide rail installed on the lower rack and a sliding block installed on the upper rack.

3. The deepwater subsea coiled tubing drilling rig according to claim 1, wherein the wellhead device comprises a base located in a middle of the bottom of the lower rack, an upper part of the base is provided with a cement head and a blowout preventer from bottom to top in sequence, and a lower part of the base is provided with a foundation conductor.

4. The deepwater subsea coiled tubing drilling rig according to claim 2, wherein the wellhead device comprises a base located in a middle of the bottom of the lower rack, an upper part of the base is provided with a cement head and a blowout preventer from bottom to top in sequence, and a lower part of the base is provided with a foundation conductor.

5. The deepwater subsea coiled tubing drilling rig according to claim 3, wherein the underwater coiled tubing system comprises a reel installed on the upper rack and a coiled tubing with cables which is wound on the reel; a free end of the coiled tubing with cables is configured for connecting the downhole tool combination; and the underwater coiled tubing system further comprises a hoisting device installed on the upper rack and an underwater heavy-load injector head installed on the hoisting device.

6. The deepwater subsea coiled tubing drilling rig according to claim 4, wherein the underwater coiled tubing system comprises a reel installed on the upper rack and a coiled tubing with cables which is wound on the reel; a free end of the coiled tubing with cables is configured for connecting the downhole tool combination; and the underwater coiled tubing system further comprises a hoisting device installed on the upper rack and an underwater heavy-load injector head installed on the hoisting device.

7. The deepwater subsea coiled tubing drilling rig according to claim 5, wherein the downhole tool combination comprises a drilling tool string and a permanent magnet electric drill which are connected in sequence; the drilling tool string is connected to the coiled tubing with cables, the permanent magnet electric drill comprises a drilling permanent magnet motor and a drill bit, and an electric measuring tool is arranged between the drilling permanent magnet motor and the drill bit.

8. The deepwater subsea coiled tubing drilling rig according to claim 6, wherein the downhole tool combination comprises a drilling tool string and a permanent magnet electric drill which are connected in sequence; the drilling tool string is connected to the coiled tubing with cables, the permanent magnet electric drill comprises a drilling permanent magnet motor and a drill bit, and an electric measuring tool is arranged between the drilling permanent magnet motor and the drill bit.

9. The deepwater subsea coiled tubing drilling rig according to claim 5, wherein the underwater connecting and disconnecting tool comprises an underwater manipulator installed inside the lower rack and at a middle of the lower rack, and an underwater iron roughneck installed at the bottom of the lower rack; the underwater connecting and disconnecting tool further comprises an underwater slip, the underwater slip comprises an upper slip and a lower slip, the upper slip is installed at a lower end of the underwater heavy-load injector head, the lower slip is installed at an upper end of the blowout preventer.

10. The deepwater subsea coiled tubing drilling rig according to claim 6, wherein the underwater connecting and disconnecting tool comprises an underwater manipulator installed inside the lower rack and at a middle of the lower rack, and an underwater iron roughneck installed at the bottom of the lower rack; the underwater connecting and disconnecting tool further comprises an underwater slip, the underwater slip comprises an upper slip and a lower slip, the upper slip is installed at a lower end of the underwater heavy-load injector head, the lower slip is installed at an upper end of the blowout preventer.

11. The deepwater subsea coiled tubing drilling rig according to claim 9, wherein two sides of the underwater manipulator are provided with tool holders, and the tool holders are fixedly connected into the lower rack.

12. The deepwater subsea coiled tubing drilling rig according to claim 10, wherein two sides of the underwater manipulator are provided with tool holders, and the tool holders are fixedly connected into the lower rack.

13. The deepwater subsea coiled tubing drilling rig according to claim 3, comprising an anti-sinking base for bearing the lifting rack, the bottom of the lower rack is provided with screw piles, and the anti-sinking base is provided with through holes corresponding to the screw piles and the wellhead device.

14. The deepwater subsea coiled tubing drilling rig according to claim 4, comprising an anti-sinking base for bearing the lifting rack, the bottom of the lower rack is provided with screw piles, and the anti-sinking base is provided with through holes corresponding to the screw piles and the wellhead device.

15. The deepwater subsea coiled tubing drilling rig according to claim 3, comprising an underwater hydraulic power unit which is arranged at the bottom of the lower rack.

16. The deepwater subsea coiled tubing drilling rig according to claim 4, comprising an underwater hydraulic power unit which is arranged at the bottom of the lower rack.

17. The deep subsea coiled tubing drilling rig according to claim 3, comprising a subsea device and a water surface device, wherein the subsea device comprises the lifting rack and equipment borne and installed by the lifting rack, and the water surface device comprises a control center installed on an auxiliary vessel; the subsea device and the water surface device are connected by a pipe cable system, and the pipe cable system comprises an umbilical cable, a suspension cable, a drilling fluid hose and a cement hose.

18. The deepwater subsea coiled tubing drilling rig according to claim 4, comprising a subsea device and a water surface device, wherein the subsea device comprises the lifting rack and equipment borne and installed by the lifting rack, and the water surface device comprises a control center installed on an auxiliary vessel; the subsea device and the water surface device are connected by a pipe cable system, and the pipe cable system comprises an umbilical cable, a suspension cable, a drilling fluid hose and a cement hose.

* * * * *